US005538155A

United States Patent [19]

Hoekstra

[11] Patent Number: 5,538,155

[45] Date of Patent: Jul. 23, 1996

[54] FLEXIBLE CONTAINER FOR BULK MATERIAL

[75] Inventor: Hendrik C. A. Hoekstra, Amsterdam, Netherlands

[73] Assignee: Koninklijke Emballage Industrie Van Leer B.V., Amstelveen, Netherlands

[21] Appl. No.: 157,126

[22] PCT Filed: Jun. 5, 1992

[86] PCT No.: PCT/NL92/00095

§ 371 Date: Feb. 15, 1994

§ 102(e) Date: Feb. 15, 1994

[87] PCT Pub. No.: WO92/21572

PCT Pub. Date: Dec. 10, 1992

[30] Foreign Application Priority Data

Jun. 5, 1991 [NL] Netherlands ..... 9100966

[51] Int. Cl.[6] ..... B65D 90/04

[52] U.S. Cl. ..... 220/403; 53/449; 220/86.1; 220/652; 220/461; 220/676

[58] Field of Search ..... 53/449, 475, 175; 383/111, 38, 105; 220/404, 403, 666, 460, 461, 445, 448, 468, 651, 652, 653, 676, 86.1, DIG. 7

[56] References Cited

U.S. PATENT DOCUMENTS

| | | | |
|---|---|---|---|
| 3,871,521 | 3/1975 | Szatkowski | 53/449 |
| 3,949,901 | 4/1976 | Tokita . | |
| 3,982,653 | 9/1976 | Becker | 220/445 |
| 4,390,051 | 6/1983 | Cuthbertson | 383/111 |
| 4,597,102 | 6/1986 | Nattrass | 383/105 |
| 4,901,885 | 2/1990 | Boots | 220/403 |
| 5,282,544 | 2/1994 | Boots | 220/403 |
| 5,287,985 | 2/1994 | Hatayama | 220/403 |
| 5,289,937 | 3/1994 | Boots | 220/403 |

FOREIGN PATENT DOCUMENTS

| | | | |
|---|---|---|---|
| 338181 | 10/1989 | European Pat. Off. | 383/111 |
| 1530621 | 6/1968 | France . | |
| 754708 | 8/1956 | United Kingdom . | |
| 1544631 | 4/1979 | United Kingdom . | |

*Primary Examiner*—Stephen J. Castellano
*Attorney, Agent, or Firm*—Young & Thompson

[57] ABSTRACT

A container for bulk material, having side walls and a bottom, in combination with an insert of flexible material. The insert has side walls of the same shape as the side walls of the container and fits removably in the container. The insert has a tubular core spaced inwardly from the side walls of the insert, this core being of flexible material and having connecting elements that extend between the core and the side walls of the insert. The insert has a filling aperture, whereby during filling of the container with bulk material, the bulk material connects initially in the core and presses the flexible material of the core radially outwardly into a cylindrical shape.

4 Claims, 4 Drawing Sheets

FLEXIBLE CONTAINER FOR BULK MATERIAL

The invention relates to a container for bulk material, which container comprises a box or bag provided with side walls and a bottom, as well as an insert of flexible material which has corresponding side walls, in such a way that in the peripheral direction of the side walls the insert fits inside the box or bag, which insert has stabilizing connecting elements fixed to its side walls for preventing them from bulging out under the influence of the bulk material.

Such a flexible container is known from GB-A-2,185,732. It is used for packing all kinds of bulk material, and can have a volume of up to one or more cubic meters. For the transportation of such containers it is desirable for them to be a block or cube shape. In that state they can be transported as economically as possible. If the pressure of the bulk material causes the containers to become more or less rounded in shape, some of the available transport space is in fact lost.

This known container has the disadvantage that, as a result of the compartmenting of the interior space through the cross-shaped insert, it cannot be filled completely in a simple way. As soon as one of the compartments determined by the insert is full, bridging can occur in the bulk material, and can block the filling aperture, with the result that the remaining compartments are completely or partially empty.

The object of the invention is therefore to provide a container of the type described above which is provided with efficient internal stabilisation means for retaining the block shape, and which can still be filled reliably. According to the invention, this is achieved in that a tubular core of flexible material is provided, to which core the connecting elements are fixed, and in that the insert has a filling aperture in such a way that during filling of the container the bulk material collects initially in the core and said bulk material presses the flexible material of the core radially outwards and pulls it taut to a cylinder shape.

As soon as the core is filled, it forms a stable cylinder, under the influence of radially outward directed pressure of the bulk material.

The core can be a ring or pipe of flexible material, on the outside of which continuous strips, or strip elements which are vertically spaced, of flexible material run vertically. The whole insert, including the stabilisation means can be folded up to a small packet, which facilitates transportation to the filling place.

The stabilisation means according to the invention preferably support the insert between its vertical edges. This ensures that the bulges of those side walls outwards remain very limited, or do not occur at all.

The interior of the container is divided into five parts by the strips of flexible material and the thin-walled core. In order to ensure that bridging cannot occur in any of these parts during filling or emptying of the container, these five regions can have approximately the same surface areas. Each of the surface areas is large enough to avoid bridging in the bulk material.

The container can be emptied in a simple way if the insert has a bottom wall with an emptying aperture situated below the core, in line with a corresponding aperture in the container wall.

Due to the fact that the horizontal measurement of the strips is approximately equal to the distance of the cylinder wall filled with the bulk material from the side walls of the container, the block shape of the container can still be retained well, despite the outward bulk material pressure exerted on the side walls. For a further description of this method of filling the container, reference is made to U.S. Pat. No. 9,100,318, which is not a prior publication.

The strips preferably comprise two interconnected layers, in such a way that one layer of a pair is always connected to an adjacent side wall half of the insert. If in this case the two layers from each strip are connected to each other near their attachment point to the core, the layers and side walls of the insert can be formed from one web of flexible material.

For a good fixing of core and strips, the layers of each pair are provided near their attachment point to the core with a pleat which is folded inwards between the layers, in which pleat the flexible material of the core is fixed. This can be carried out by, for example, sewing, but a glued connection or a connection obtained by pressing the materials when hot is also suitable.

In order to ensure that the container provided with an insert can be filled properly, the core and/or the side walls extend over the entire height of the bag, and it is provided with holes. The bulk material is now fed centrally into the core, so that the latter is initially pulled taut. The material collecting in the core can also pass through the holes into the space surrounding it. In order to be able to fill the whole container correctly, the holes can be made relatively small near the bottom of the bag, and relatively large near the filling aperture.

The insert according to the invention may or may not be provided with a bottom. This bottom can be obtained by, for example, joining together the walls of the insert. Of course, in that case the walls of the insert must have such a measurement in height that after the lower wall part of the insert is joined the insert has the desired measurements. In the absence of a bottom, the lower edge of the insert can be cut into, and the tongues formed between the incisions can then lie on the bottom of the bag. With this design it can be ensured that the bulk material does not penetrate between the bag and the insert while, on the other hand, it can be ensured that the insert is not pulled too far towards the bottom of the bag under the influence of the weight of the bulk material.

As already mentioned above, the insert can be placed in a standard box or bag. If said box or bag is waterproof or dustproof, the stabilised container thus obtained is also dustproof or waterproof.

The invention now also provides the possibility of producing a dustproof or waterproof stabilised container with a box or bag which is not dustproof or waterproof itself. For this, a lining which is the same shape as the bag can be placed between bag and insert.

If said lining projects beyond the top edge of the bag, it can be connected all the way round to the free end of an also projecting core of the insert. The whole container can be filled through the core of the insert, following which the lining can be closed together with the end of the core by means of, for example, a cord.

Bag, insert and/or the lining can also be secured by glued connections.

As stated above, the insert and the lining can be placed loose in the box or bag. However, in order to prevent any slippages between them, this insert and/or the lining can be secured in the bag by glued connections.

In particular, with the design of the insert which is provided with tongues, said tongues can be glued on the bottom of the bag or lining.

The invention will be explained in greater detail below with reference to a number of examples of embodiments.

Figure 2A:
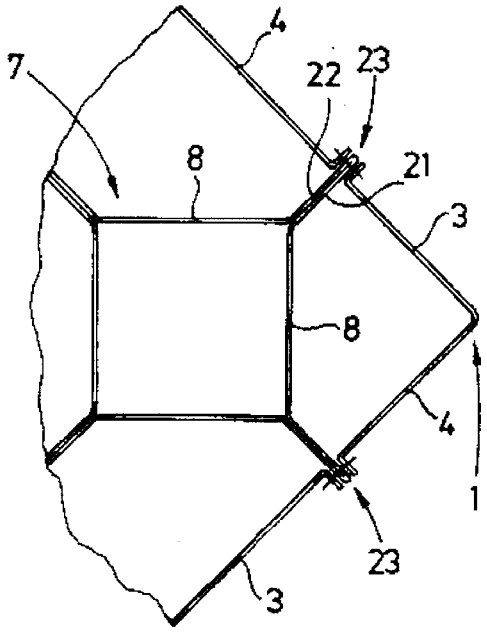
FIG. 2 shows a detail of the insert according to FIG. 1.

FIG. 2*a* shows an alternative detail.

Figure 3:
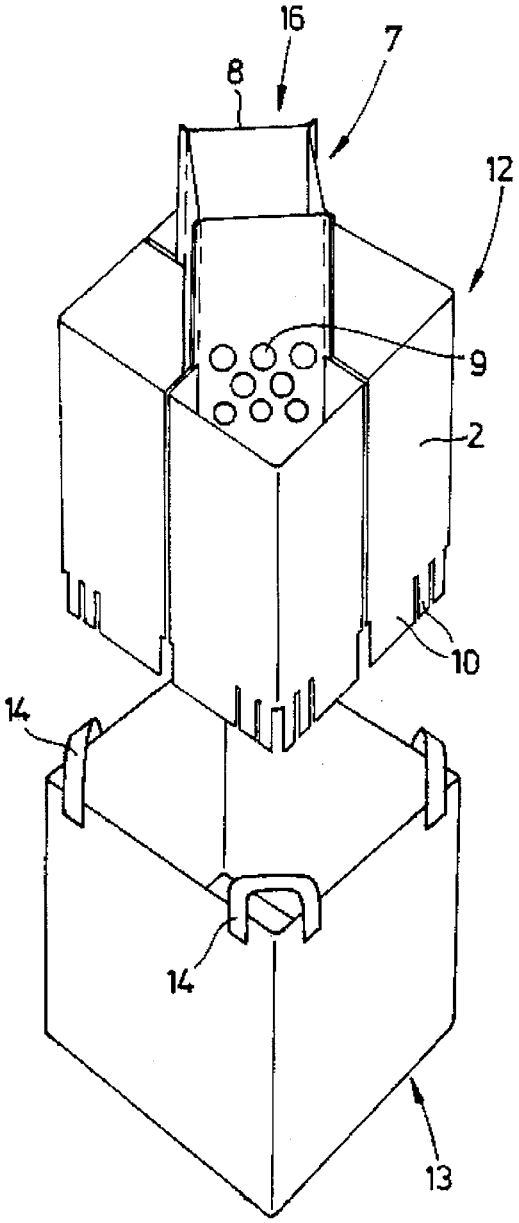

FIG. 3 shows an insert before insertion into a bag.

Figure 4:
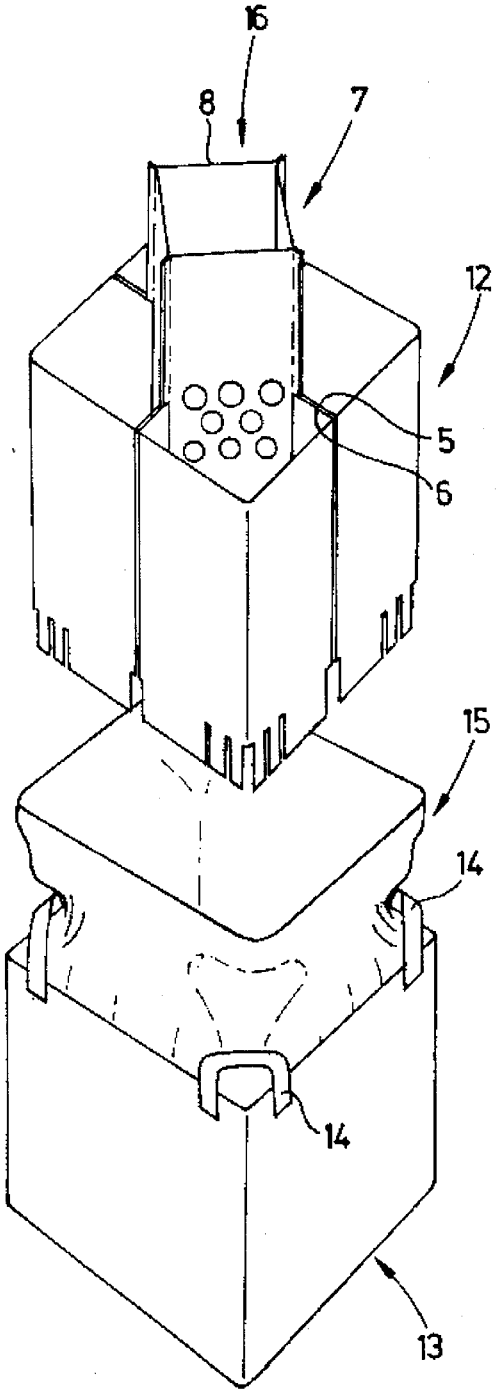

FIG. 4 shows an insert before it is inserted into a bag with a lining.

Figure 5:
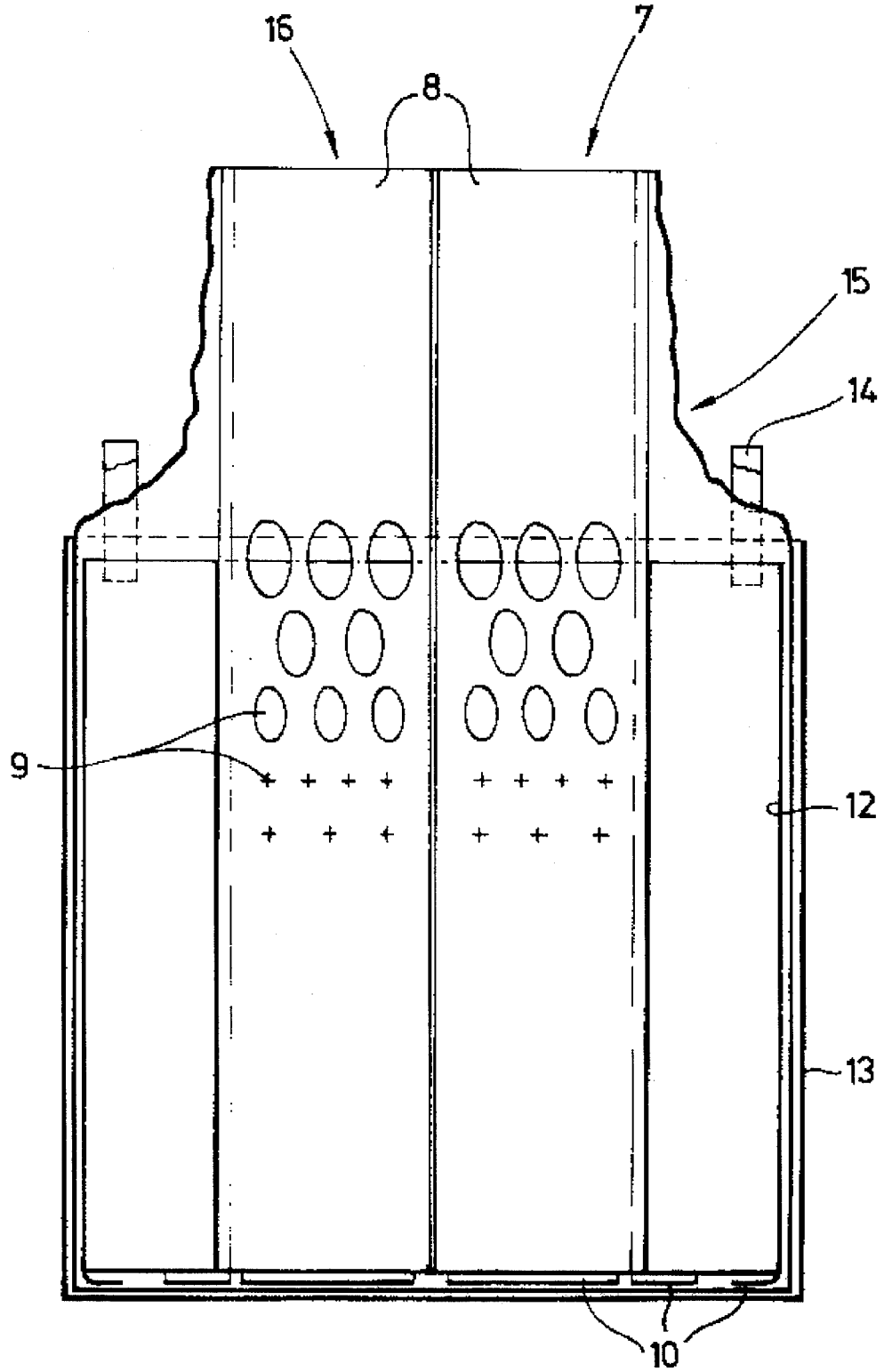

FIG. 5 shows a side view of an insert, lining and bag.

Figure 6:
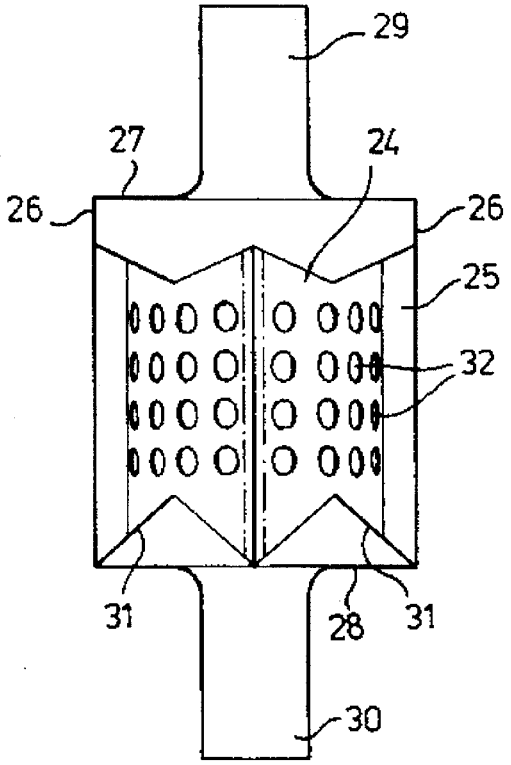

FIG. 6 shows an alternative embodiment of the insert.

Figure 7A:
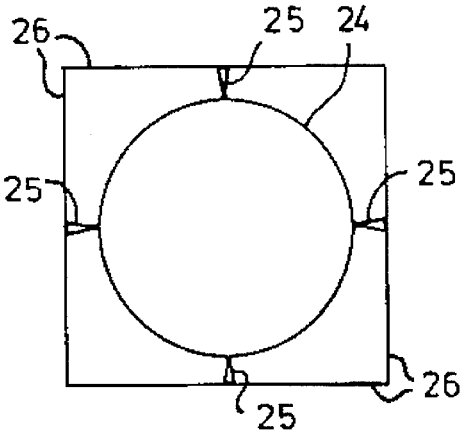
Figure 7B:
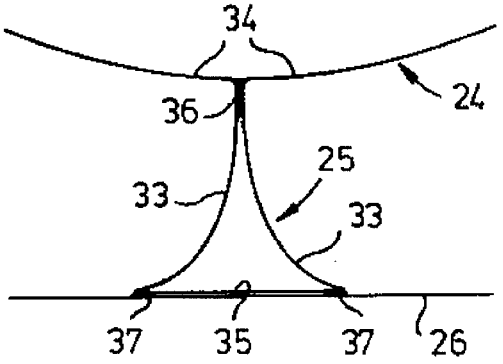

FIGS. 7*a* and 7*b* show a horizontal section and fastening detail respectively of the insert according to FIG. 6.

Figure 1:
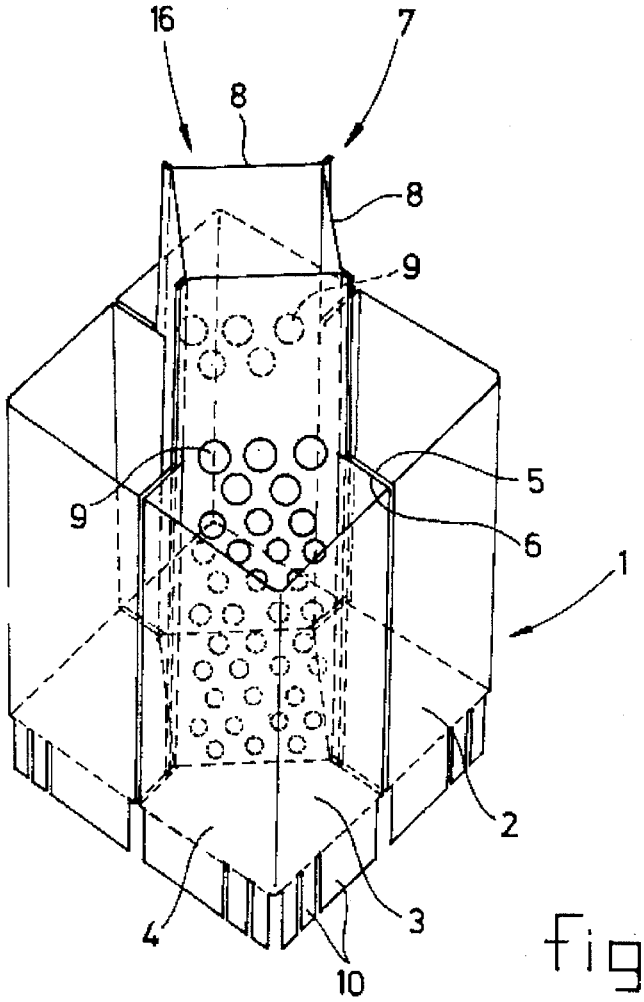
FIG. 1 shows an insert according to the invention in perspective.

The insert of flexible material shown in FIG. 1 comprises side walls 1, each consisting of two halves 2, 3. The half 3 of one side wall 1 is connected to half 4 of an adjacent side wall 1, in such a way that in the insert adjacent side wall halves are always connected to each other.

The side wall halves of each side wall are bent over at their facing ends to form layers 5, 6. These layers 5, 6 are each connected to the thin-walled core, indicated in its entirety by 7, in the inside of the insert. This internal core has four walls 8.

The thin-walled core 7 is provided with holes 9. The top holes 9 have a relatively large diameter, while the bottom holes 9 have a relatively small diameter.

For the rest, the side walls are grooved at their underside, to form tongues 10. The function of these tongues will be explained later.

The adjacent side wall halves 3, 4 of the two side walls 1 are integral. There are four of such interconnected side wall halves in the insert. They can be fixed as separated pieces to the core 7, but all side wall halves 3, 4 are preferably made from one and the same web of flexible material.

Figure 2:
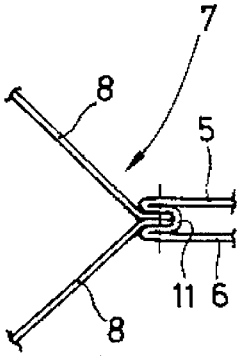

This means that, for example, the side wall halves 2, 3 are integral near their attachment point to the core 7. This is shown in FIG. 2.

In order still to be able to fix the wall parts 8 of the core 7 to the layers 5, 6 the material from which said layers 5, 6 is made is folded inwards to form a pleat 11. The material of the wall parts 8 of the core 7 is accommodated in this pleat. The wall parts 8 can be fixed in the pleat 11 by sewing, or by gluing or hot pressing, in such a way that melting occurs.

However, as an alternative, the wall parts 8 of the core can also be made integral with layers 21, 22. These layers 21, 22 are in turn made integral per pair, and are sewn in with their flat-folded outer edge between two side wall halves 3, 4 in each case, at seam 23. Glueing or hot bonding in such a way that melting occurs is also possible.

FIG. 3 shows an insert 12 which is to be placed in a bag 13 of flexible material. This bag 13 is provided with suspension loops 14, by means of which the assembled bag 12, 13 can be lifted. As will be clear, the core 7 forms a filling aperture 16, by means of which the bag 13 can be filled. The tongues 10 prevent the filling material from collecting between insert 12 and bag 13.

In this embodiment the purpose of the insert 12 is to prevent the bag 13 from bulging out under the influence of the load of the bulk material.

In the variant shown in FIG. 4 a waterproof or dustproof lining 15 is placed in the bag 13. Here again, the insert 12 can be placed in the bag 13 provided with the lining 15. This embodiment not only provides stabilisation to prevent bulging out of the bag 13 under the influence of the bulk material, but the lining 14 also guarantees that it is dustproof or waterproof. The lining 14 can be fitted without problems between the bag 13 and the insert 12, since they need not be fixed to each other. Nevertheless, the lining 14 can be held in the correct position in the bag 13 by, for example, a glued connection, while the insert 12 can also in turn be held securely in the bag 14 by a glued connection. These glued connections are, however, necessary only to ensure the correct positions of these parts relative to each other. They do not fulfil any function in stabilising the bag.

FIG. 5 shows the embodiment of the bag according to FIG. 4 in the assembled state. Insert 12 and lining 14 are in this case fitted in their correct position in the bag 13, left as they are or connected together by glued connections. The filling aperture 16 projects above the top edge of the bag 13, while the lining 15 also runs through beyond the top edge. Near their top end, insert 12 and lining 15 are joined together, for example by means of a glue or a welded seam.

The bag according to FIG. 5 can be filled through the filling aperture 16. The filling material first of all collects on the bottom of the bag inside the core 7, in such a way that this core is pulled taut until it is essentially a circular shape, as also described in U.S. Pat. No. 9,100,318, which is not a prior publication. The bulk material in this case also passes out through the holes 9 in the core 7, in such a way that the four compartments between the core 7 and the side walls of the insert 12 are filled. The tongues 10 prevent the filling material from collecting between the lining 15 and the insert 12. On the other hand, the size of the tongues 10, compared with a full bottom, is so small that the insert cannot be pulled downwards under the influence of the bulk material, in such a way that in the end it is lying too low down in the bag.

Once the bag is full, the core 7 can be shut off near the filling aperture 16, for example by means of a cord.

The variant of FIG. 6 shows an insert in which one side wall is cut away, so that the core 24 and the strips 25 by which it is fixed to the side walls 26 of the insert can be seen. The top wall 27 and the bottom wall 28 of the insert are each provided with a filling hose 29 and an emptying hose 30. These hoses 29, 30 can be shut off in any desired way, for example by making a knot in them.

The core 24 has V-shaped recesses at its top and bottom side. The purpose of the V-shaped recesses 31 at the bottom side is to give the bulk material lying outside the core 24 the chance to flow to the emptying aperture 30.

Holes 32 are also provided in the core 34, so that as it reaches an increasingly high level in the core 24 during filling through the filling hose 29, the bulk material can also flow through these holes into the compartments lying outside the core 24.

In the bottom of the bag in this embodiment there must, of course, be a hole through which the emptying hose 30 can project outwards.

The walls 26 of the insert and also the core, indicated in its entirety by 24, can be seen in the top view of FIG. 7*a*. This core is fixed by means of the strips 25 to the walls 26.

The core 24 and the strips 25 be made in one piece, as can be seen clearly in FIG. 7*b*. Each strip 25 comprises two separate layers 33, which merge into the wall parts 34 of the core 24. At the other sides the layers 33 are each connected by means of a part 35 integral therewith.

The layers 33 are also interconnected by means of a weld 36, and are connected to the wall 26 by means of welds 37. These two separate fixing points 37 lying some distance apart have a beneficial effect on the load transferred from the outward loaded wall 26 by means of strip 25 to core 24.

I claim:

1. A container for bulk material, having side walls and a bottom, in combination with an insert of flexible material, said insert having side walls of the same shape as the side walls of the container, the insert fitting removably in the container, the insert having a tubular core spaced inwardly from said side walls of said inset, said core being of flexible material and having connecting elements that extend between said core and said side walls of said insert, the insert having a filling aperture, whereby during filling of the container with bulk material, the bulk material collects initially in the core and presses the flexible material of the core radially outwardly into a cylindrical shape, wherein said insert has a rectangular cross section in a plane perpendicular to all said side walls of said insert, and said connecting elements extending between said core and midpoints of said side walls of said insert.

2. A container according to claim 1, wherein said core extends at least full height of the insert and has holes therethrough.

3. A container according to claim 2, wherein said holes vary in size along the vertical extent of the core and are larger adjacent an upper portion of the core and smaller adjacent a lower portion of the core.

4. A container according to claim 1, wherein said core when empty also has a rectangular cross section in said plane, and said connecting elements extending between corners of said core and midpoints of said side walls of said insert.

* * * * *